US011628545B2

(12) United States Patent
Lai

(10) Patent No.: US 11,628,545 B2
(45) Date of Patent: Apr. 18, 2023

(54) HAND TOOL AND A METHOD FOR MAKING THE SAME

(71) Applicant: Shih-Hao Lai, Taichung (TW)

(72) Inventor: Shih-Hao Lai, Taichung (TW)

( * ) Notice: Subject to any disclaimer, the term of this patent is extended or adjusted under 35 U.S.C. 154(b) by 397 days.

(21) Appl. No.: 16/279,922

(22) Filed: Feb. 19, 2019

(65) Prior Publication Data

US 2023/0010807 A1 Jan. 12, 2023

(51) Int. Cl.
*B25B 23/00* (2006.01)
*B25B 13/46* (2006.01)

(52) U.S. Cl.
CPC ..... *B25B 23/0028* (2013.01); *B25B 13/465* (2013.01); *B25B 23/0035* (2013.01)

(58) Field of Classification Search
CPC ..... B25B 23/0028; B25B 23/0035; B25B 13/465; B23P 11/00; B23P 15/00; Y10T 29/537
USPC ..... 29/428, 525, 525.11; 81/177.6, 177.7, 81/177.8, 177.9; 76/114
See application file for complete search history.

(56) References Cited

U.S. PATENT DOCUMENTS

2013/0139653 A1* 6/2013 Mennecke, IV ..... B25B 13/465 81/58.1
2018/0065234 A1* 3/2018 Chien ..... B25B 13/465

* cited by examiner

*Primary Examiner* — Lee D Wilson
*Assistant Examiner* — Alberto Saenz

(57) ABSTRACT

A handle extends about a first axis and includes a bifurcated portion. The bifurcated portion includes a concave face and two screw holes along a second axis. A toothed ring extends about a third axis and includes a convex face in compliance with the concave face and two bores along a fourth axis. The toothed ring is moved into a space in the concave face while keeping the third axis parallel to the second axis. The third axis is overlapped with the second axis and a center of the toothed ring is near or coincides with a middle point of a segment of the second axis in the bifurcated portion. The toothed ring is rotated about the first axis so that the fourth axis is overlapped with the second axis and the bores are aligned with the screw holes. Two screws are inserted in the screw holes and the bores.

3 Claims, 14 Drawing Sheets

HAND TOOL AND A METHOD FOR MAKING THE SAME

BACKGROUND OF INVENTION

1. Field of Invention

The present invention relates to a hand tool and, more particularly, to a hand tool and a method for making the same.

2. Related Prior Art

Referring to FIGS. 10 and 11, a wrench 92 includes an engagement element 926 connected to a bifurcated portion 924 of a Y-shaped handle 922 by two screws B. The engagement device 926 can be pivoted on the handle 922. The engagement element 926 is engaged with a head of a threaded bolt or a nut (not shown) at a desired size. Thus, the wrench 92 is operable to rotate the threaded bolt or the nut. The engagement element 926 includes two planar faces (not numbered) that face two planar faces of the bifurcated portion 924 of the Y-shaped handle 922 of the wrench 92 when the engagement element 926 is supported on the bifurcated portion 924 of the Y-shaped handle 922 of the wrench 92. There is a large gap A between each planar face of the bifurcated portion 924 and the corresponding planar face of the engagement element 926. The large gaps A render the connection of the engagement element 926 to the bifurcated portion 924 easy. However, the large gaps A cause the screws B under extremely large stress in operation.

Referring to FIGS. 12 to 14, a wrench 94 includes an engagement element 946 connected to a bifurcated portion 944 of a Y-shaped handle 942 by two screws B. The engagement element 946 can be pivoted on the handle 942. The engagement element 946 is engaged with a head of a threaded bolt or a nut (not shown) at a desired size. Thus, the wrench 94 is operable to rotate the threaded bolt or the nut. The engagement element 946 includes two convex faces (not numbered) that face two arched faces of the bifurcated portion 944 of the Y-shaped handle 942 of the wrench 94 as the engagement element 946 is supported on the bifurcated portion 944 of the Y-shaped handle 942 of the wrench 94. There is a large gap A between each arched face of the bifurcated portion 944 and the corresponding convex face of the engagement element 946. The large gaps A render the connection of the engagement element 946 to the bifurcated portion 944 easy. However, the large gaps A cause the screws B under extremely large stress in operation.

Referring to FIGS. 15 to 17, a wrench 96 includes an engagement element 966 connected to a bifurcated portion 964 of a Y-shaped handle 962. The engagement element 966 can be pivoted on the handle 962. The engagement element 966 includes two axles 9662. The handle 962 is made with a slit 9622 to allow expansion of the bifurcated portion 964 of the handle 962 to allow insertion of the axles 9662 into two apertures (not numbered) made in the bifurcated portion 964 of the handle 962. A screw (not numbered) is driven in the handle 962 to keep the width of the slit 9622 to keep the engagement element 966 on the bifurcated portion 964 of the handle 962. The engagement element 966 includes two convex faces (not numbered) that face two arched faces of the bifurcated portion 964 of the Y-shaped handle 962 of the wrench 96 when the engagement element 966 is supported on the bifurcated portion 964 of the Y-shaped handle 962 of the wrench 96. There is a large gap A between each arched face of the bifurcated portion 964 and the corresponding convex face of the engagement element 966. The large gaps A render the connection of the engagement element 966 to the bifurcated portion 964 easy. However, the large gaps cause the axles 9662 under extremely large stress in operation.

The present invention is therefore intended to obviate or at least alleviate the problems encountered in the prior art.

SUMMARY OF INVENTION

It is the primary objective of the present invention to provide a method for making a robust and reliable hand tool.

To achieve the foregoing objective, the method includes the step of providing a handle and a toothed ring. The handle extends about a first axis and includes a bifurcated portion. The bifurcated portion includes a concave face and two screw holes along a second axis. The toothed ring extends about a third axis and includes a convex face in compliance with the concave face and two bores along a fourth axis. The toothed ring is moved into a hemi-circular space in the concave face while keeping the third axis parallel to the second axis. The third axis is overlapped with the second axis and a center of the toothed ring is near or coincides with a middle point of a segment of the second axis in the bifurcated portion. The toothed ring is rotated about the first axis so that the fourth axis is overlapped with the second axis and that the bores are aligned with the screw holes. Two screws are inserted in the screw holes and the bores.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
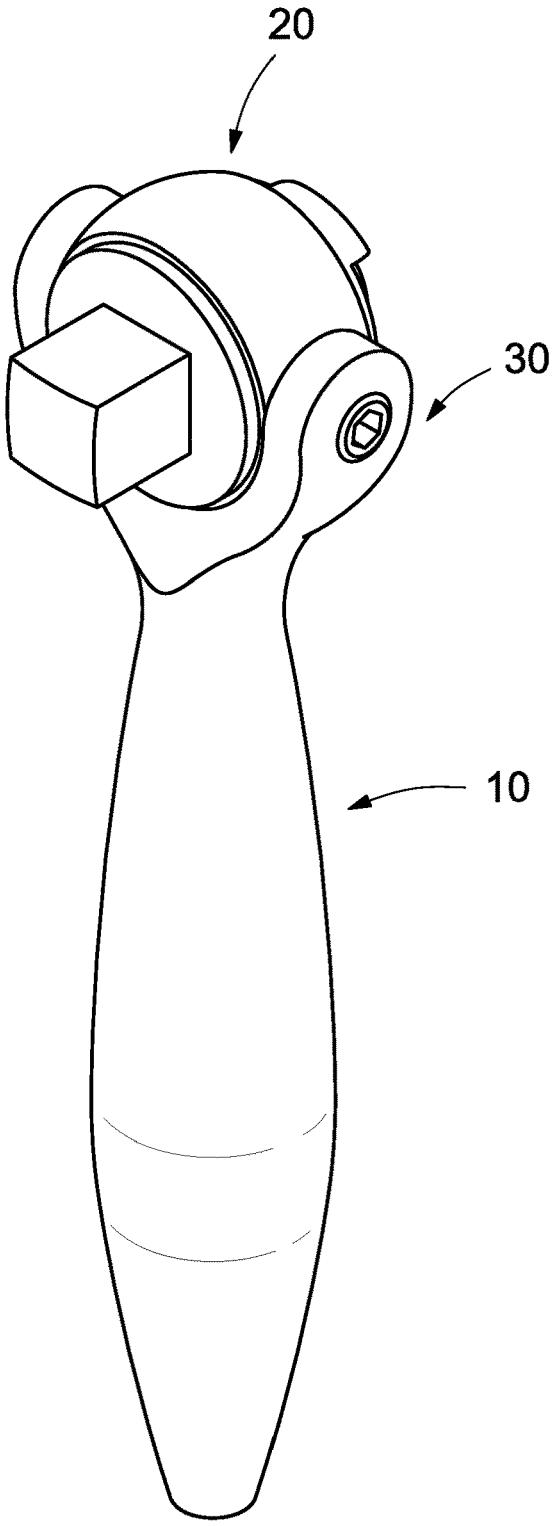
FIG. 1 is a perspective view of a hand tool according to the preferred embodiment of the present invention.
Figure 2:
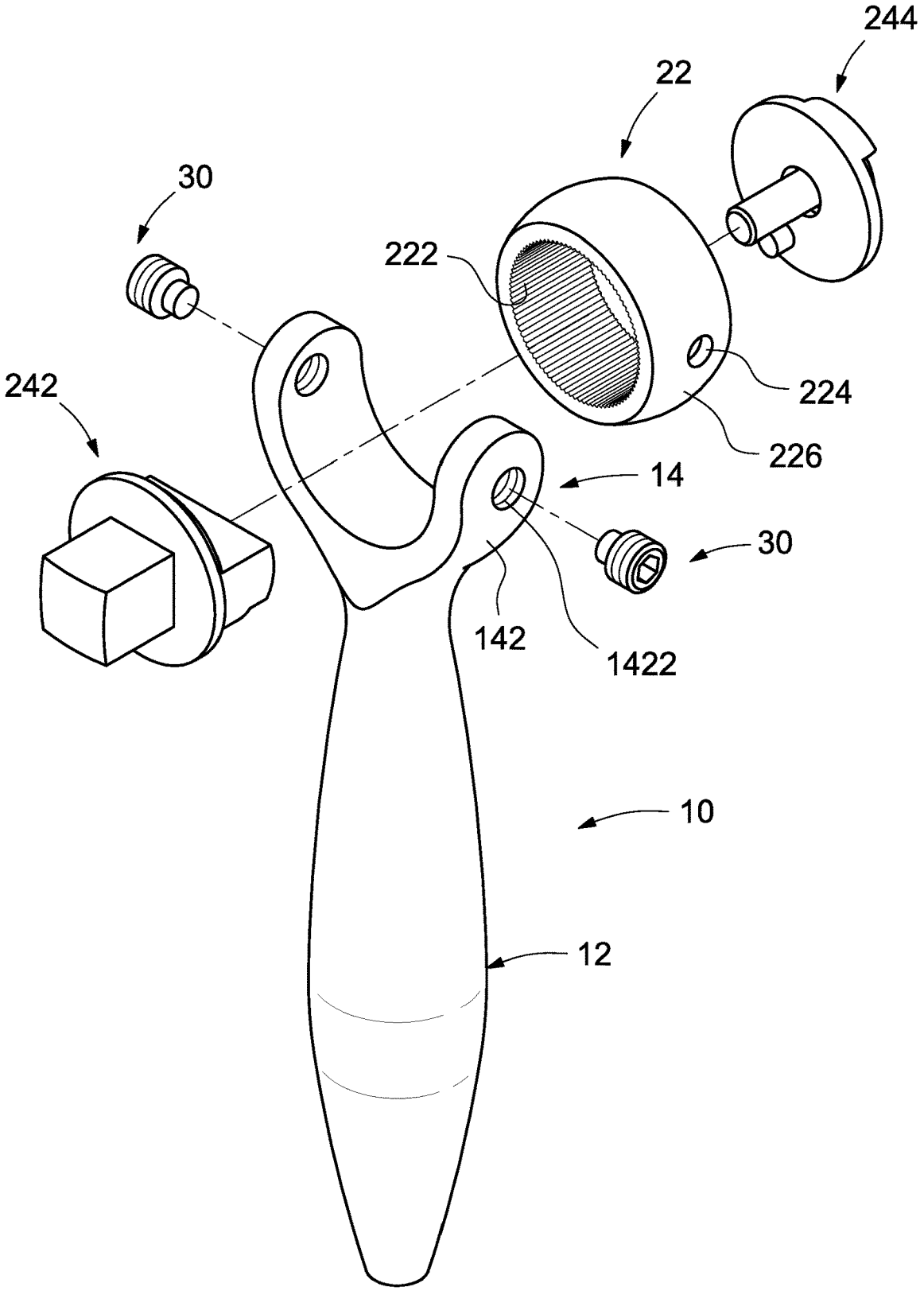
FIG. 2 is an exploded view of the hand tool shown in FIG. 1.
Figure 2A:
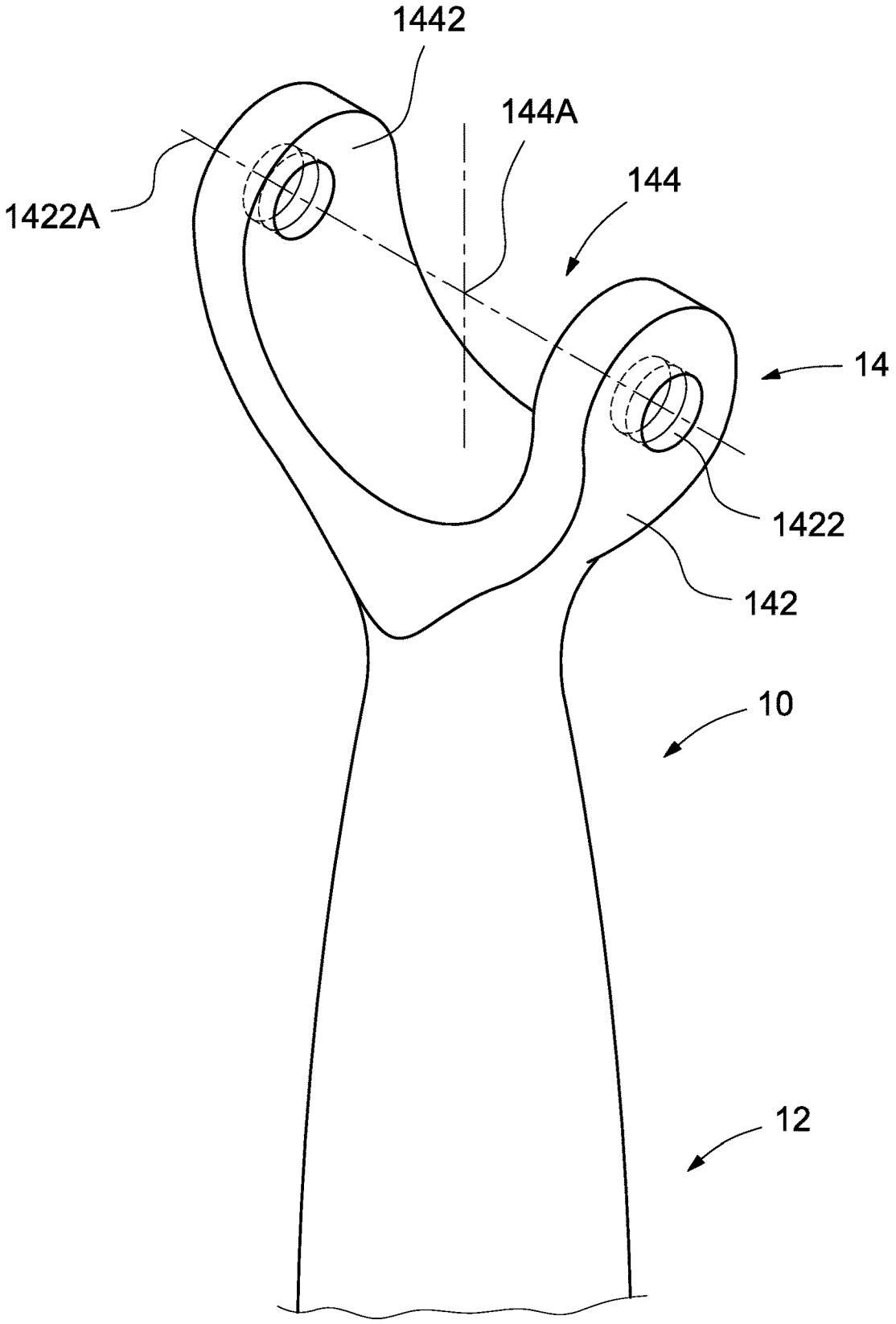
FIG. 2*a* is an enlarged partial view of a handle of the hand tool shown in FIG. 1.

Referring to FIGS. 1 to 2*a*, a hand tool includes a handle 10, an engagement device 20 and two screws 30 according to the preferred embodiment of the present invention.

The handle 10 includes a grip 12 at an end and a bifurcated portion 14 at another end.

The grip 12 is to be held and maneuvered by a user.

The bifurcated portion 14 includes two prongs 142 and a hemi-circular space 144. The prongs 142 extend away from each other as they extend from the grip 12. Each of the prongs 142 includes a screw hole screw hole 1422. The hemi-circular space 144 is located between and defined by the prongs 142. A middle point 144A of a segment extending between the prongs 142 along a common axis of the screw holes 1422 can be referred to as a center of a phantom circle defined by the prongs 142. The bifurcated portion 14 of the handle 10 includes a concave face 1442 that defines the hemi-circular space 144. The concave face 1442 is a portion of a spherical face extending about the point 144A. The point 144A is located lower than free ends of the prongs 14.

The engagement device 20 includes a toothed ring 22 and a selectively one-way rotating device 24.

The toothed ring 22 extends about an axis. The toothed ring 22 includes teeth 222 formed on the inside, two bores 224 and a convex face 226 formed on the outside. The teeth 222 are ordinary teeth or ratchet teeth. The bores 224 are located corresponding to the screw holes 1422. Each of the bores 224 is shaped in compliance with a reduced end of a corresponding screw 30. The convex face 226 is shaped in compliance with the concave face 1442 of the hemi-circular space 144. That is, the convex face 226 is a portion of a spherical face.

The selectively one-way rotating device 24 includes a rotor 242 and a switch 244. The rotor 242 includes an internal portion inserted in the toothed ring 22 and an external portion for engagement with a socket, a head of a threaded bolt or a nut in use. The switch 244 includes an internal portion inserted in the toothed ring 22 and an external portion to be maneuvered by the user to select one from two opposite directions in which the toothed ring 22 rotates the rotor 242. The selectively one-way rotating device 24 includes other elements (not shown) connected to the teeth 222, the rotor 242 and the switch 244. However, the selectively one-way rotating device 24 will not be further described for being conventional.

The screws 30 are inserted in the screw holes 1422 in the prongs 142. The reduced ends of the screws 30 are inserted in the bores 224 of the tooted ring 22. Thus, the toothed ring 22 is pivotally connected to the bifurcated portion 14 of the handle 10.

Figure 3:
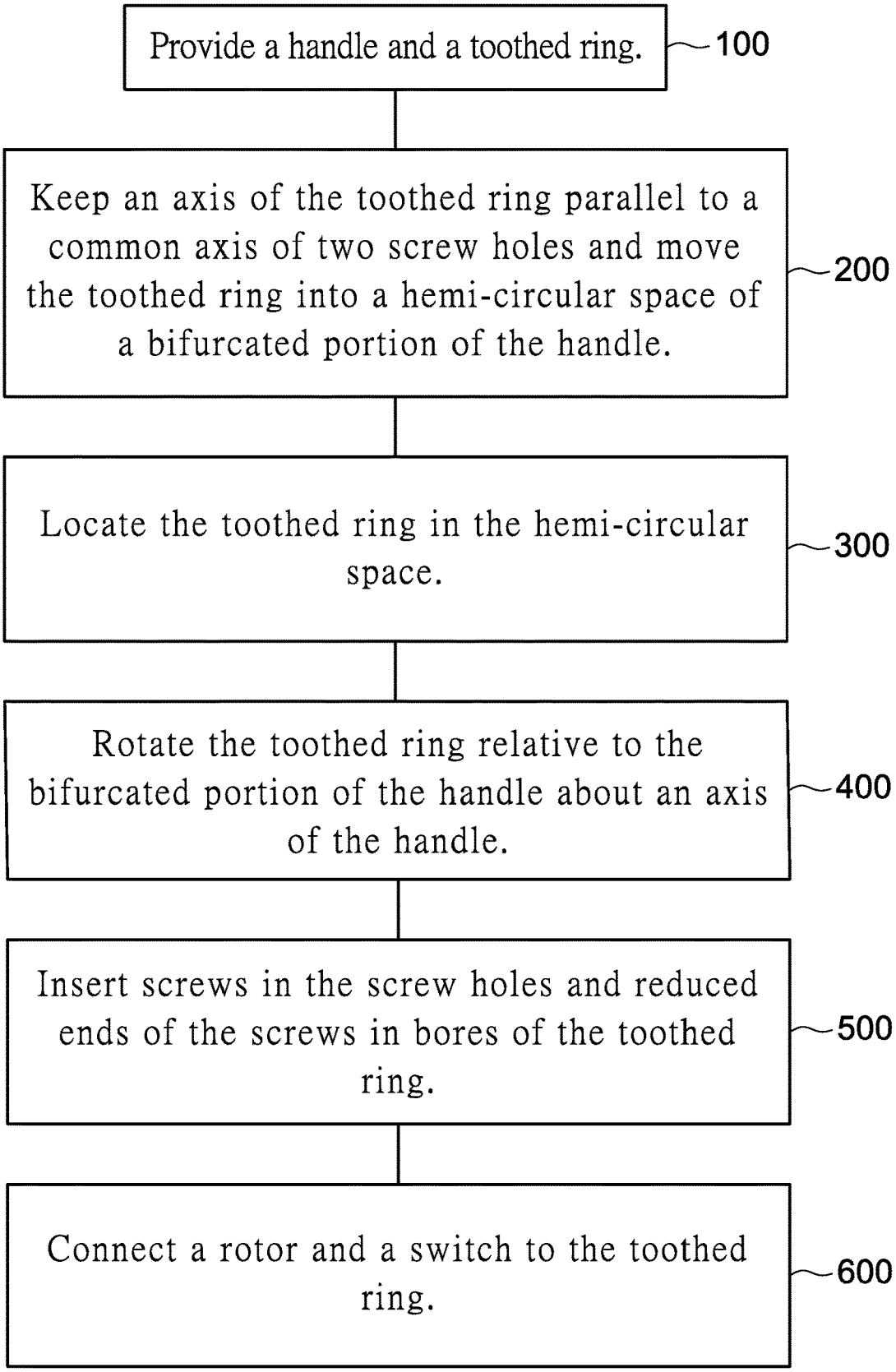
FIG. 3 is a flow chart of a method for making the hand tool shown in FIG. 1.

A diameter of the convex face 226 is marginally smaller than that of the concave face 1442. That is, a gap between the convex face 226 and the concave face 1442 is small. Hence, the screws 30 are subjected to relatively small stress in operation. However, it is difficult to expand the bifurcated portion 14 of the handle 10 to insert the toothed ring 22 in the bifurcated portion 14 of the handle 10. The toothed ring 22 can only be smoothly inserted in the bifurcated portion 14 of the handle 10 in a method to be described referring to FIG. 3.

At 100, the handle 10 and the toothed ring 22 are provided.

Figure 4:
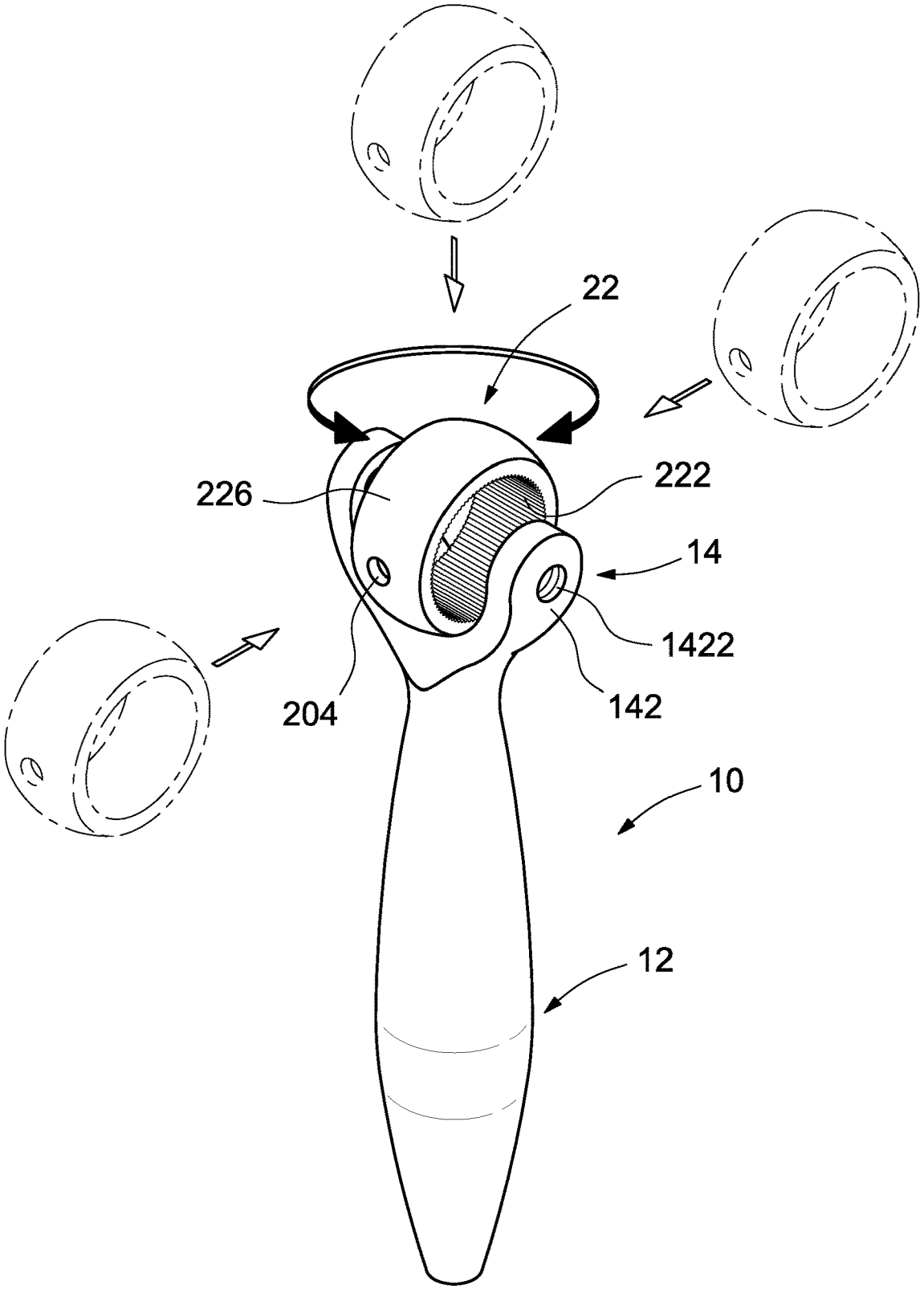
FIG. 4 is a perspective view of the hand tool at a first stage in the method shown in FIG. 3.

At 200, the axis of the toothed ring 22 is kept parallel to the common axis of the screw holes 1422 and the toothed ring 22 is moved into the hemi-circular space 144 of the bifurcated portion 14 of the handle 10 (FIG. 4).

Figure 5:
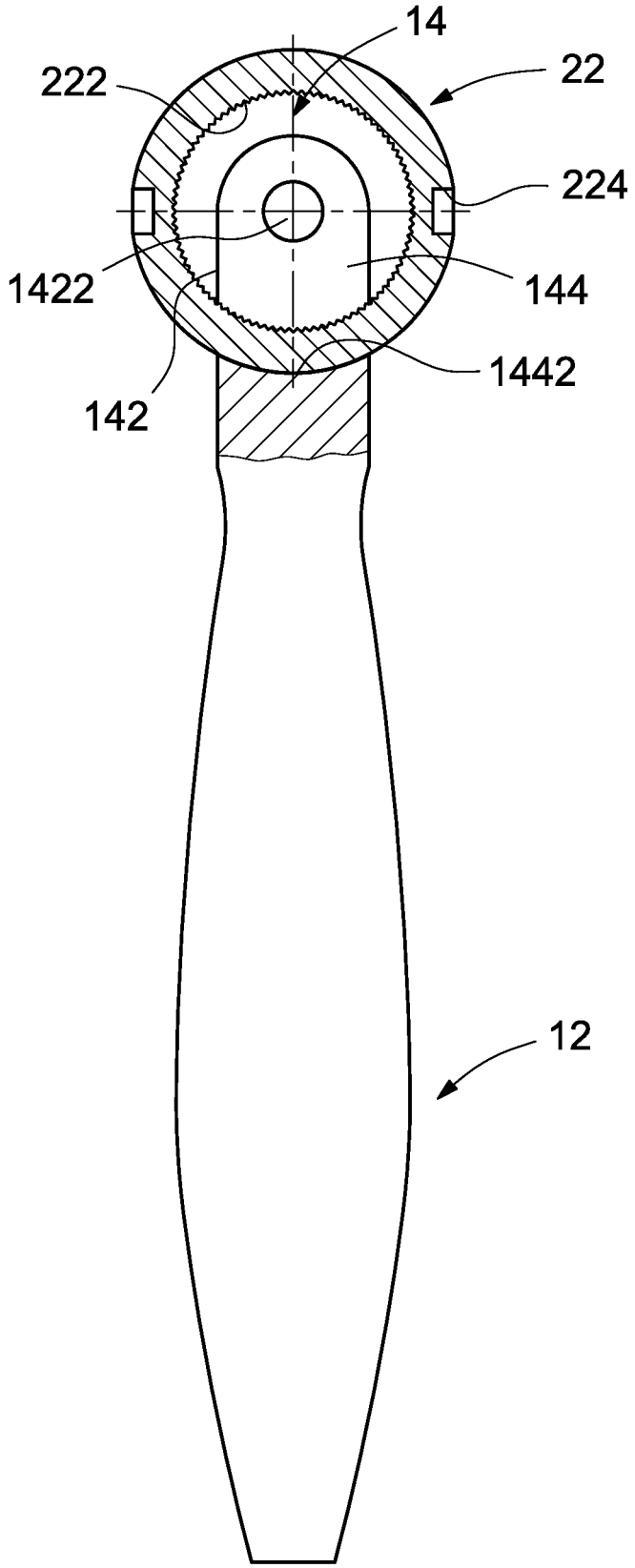
FIG. 5 is a cross-sectional view of the hand tool at a second stage in the method shown in FIG. 3.
Figure 6:
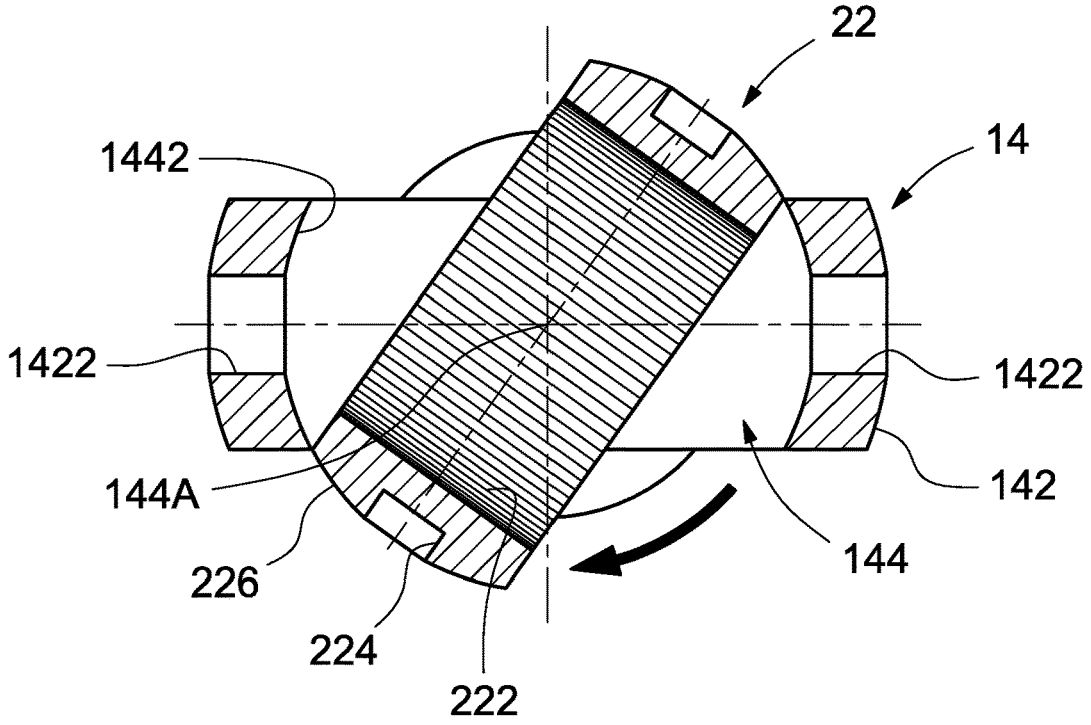
FIG. 6 is a cross-sectional view of the hand tool at a third stage in the method shown in FIG. 3.
Figure 7:
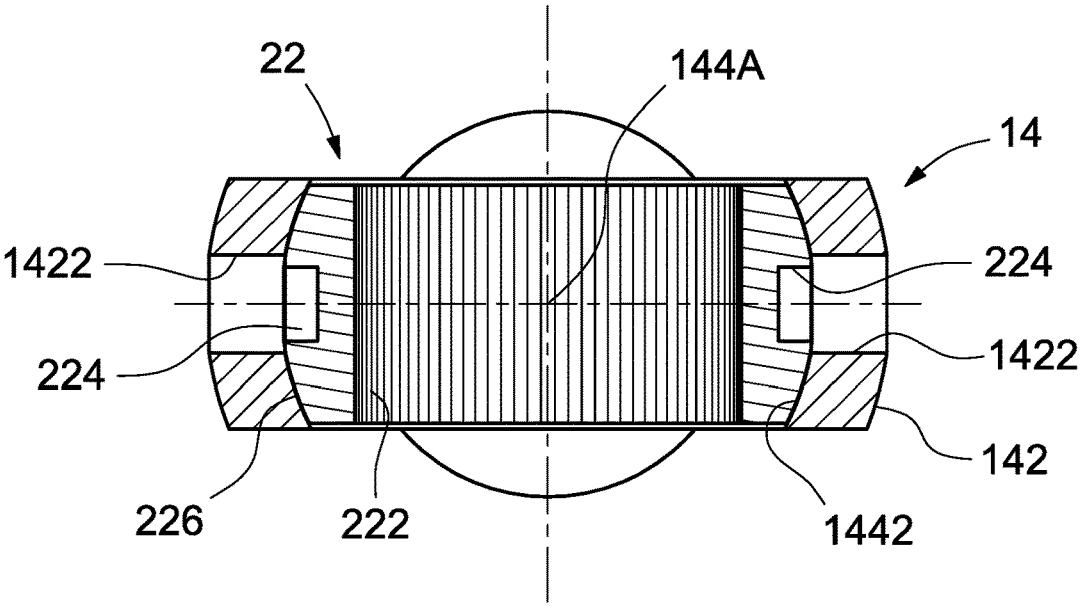
FIG. 7 is a cross-sectional view of the hand tool at a fourth stage in the method shown in FIG. 3.
Figure 8:
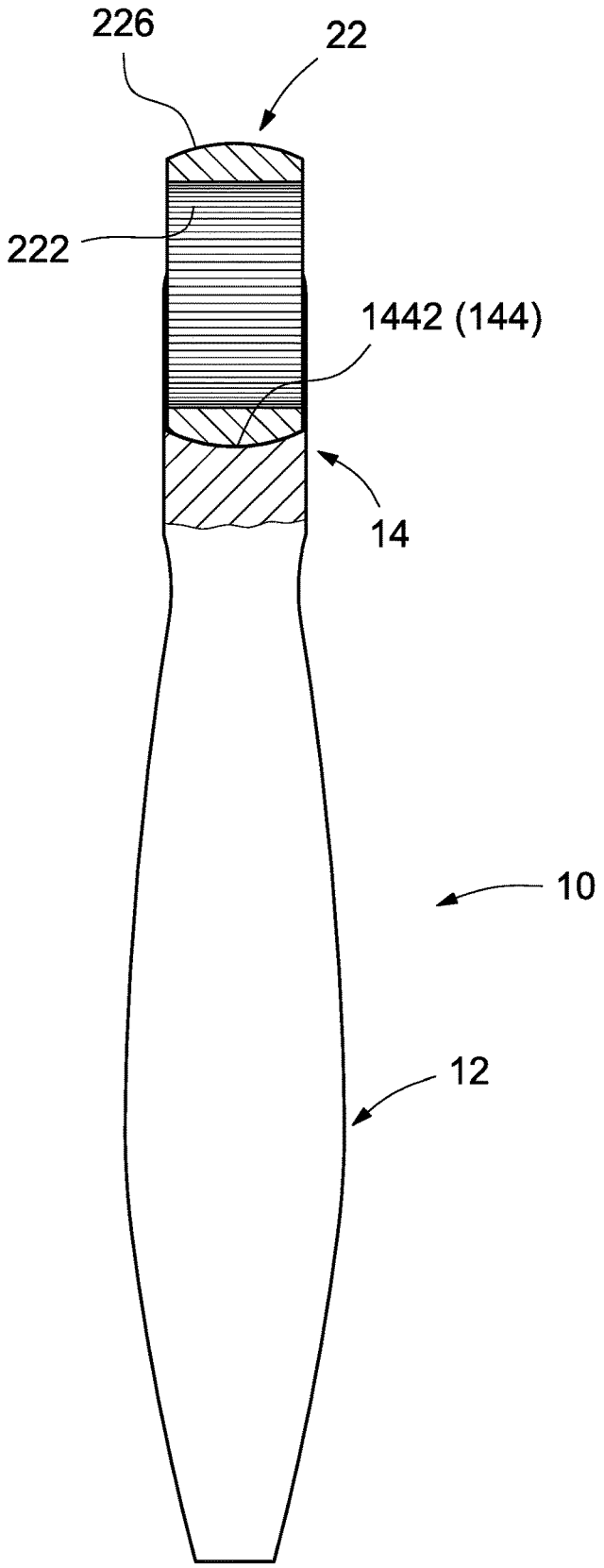
FIG. 8 is a cross-sectional view of the hand tool at a fifth stage in the method shown in FIG. 3.
Figure 9:
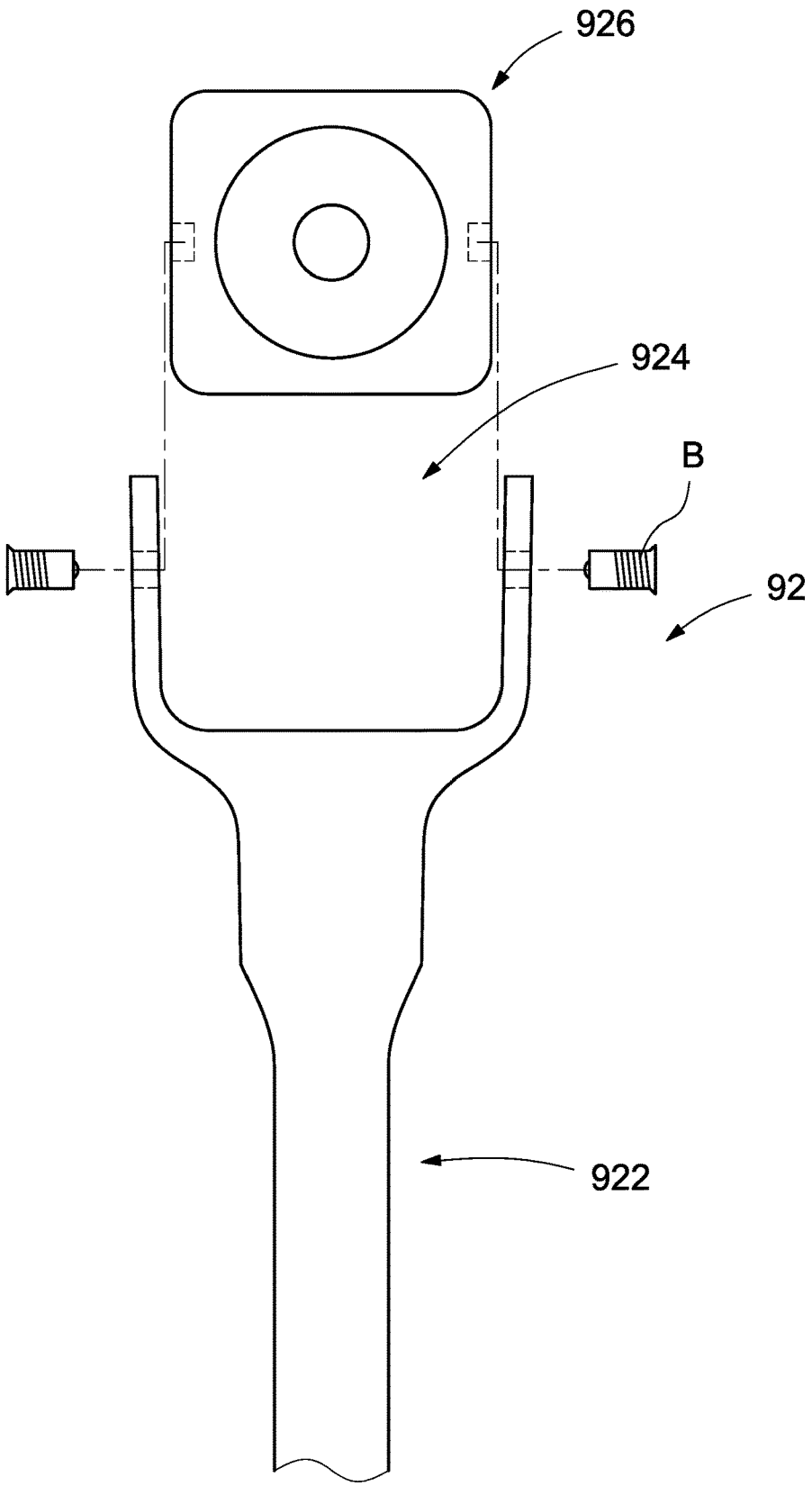
FIG. 9 is an exploded view of a conventional hand tool.
Figure 10:
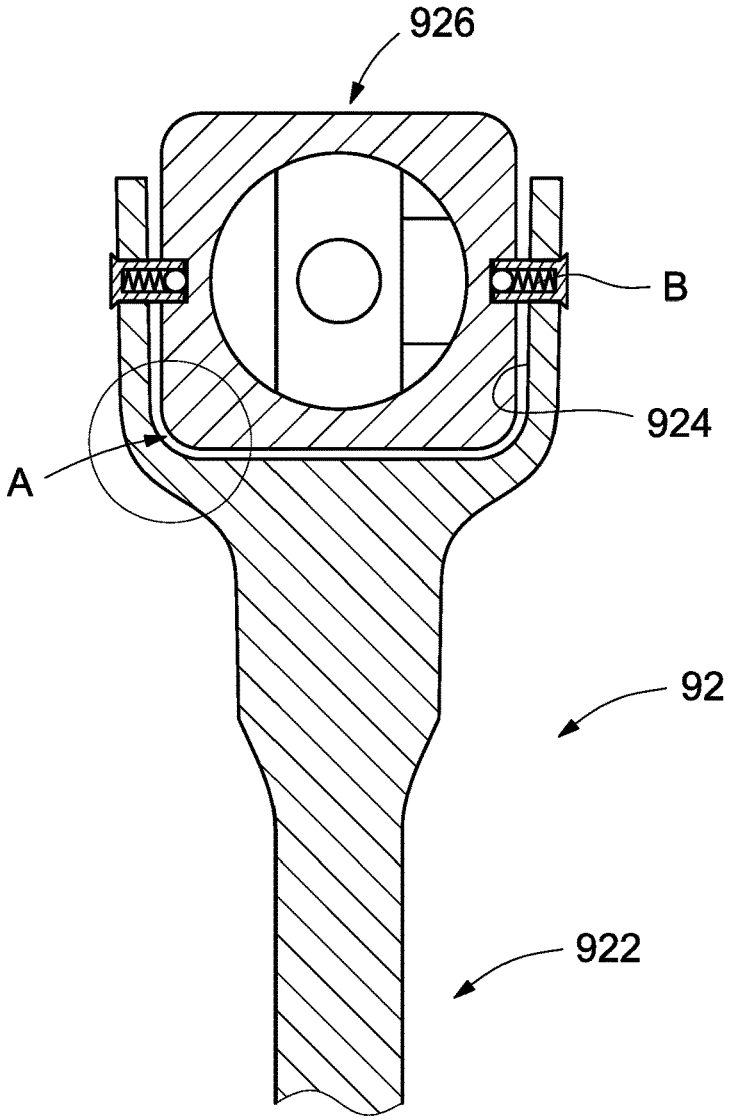
FIG. 10 is a cross-sectional view of the hand tool shown in FIG. 9.
Figure 11:
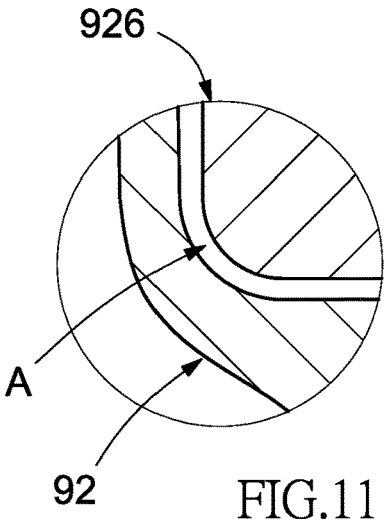
FIG. 11 is a detailed view of a portion of FIG. 10.
Figure 12:
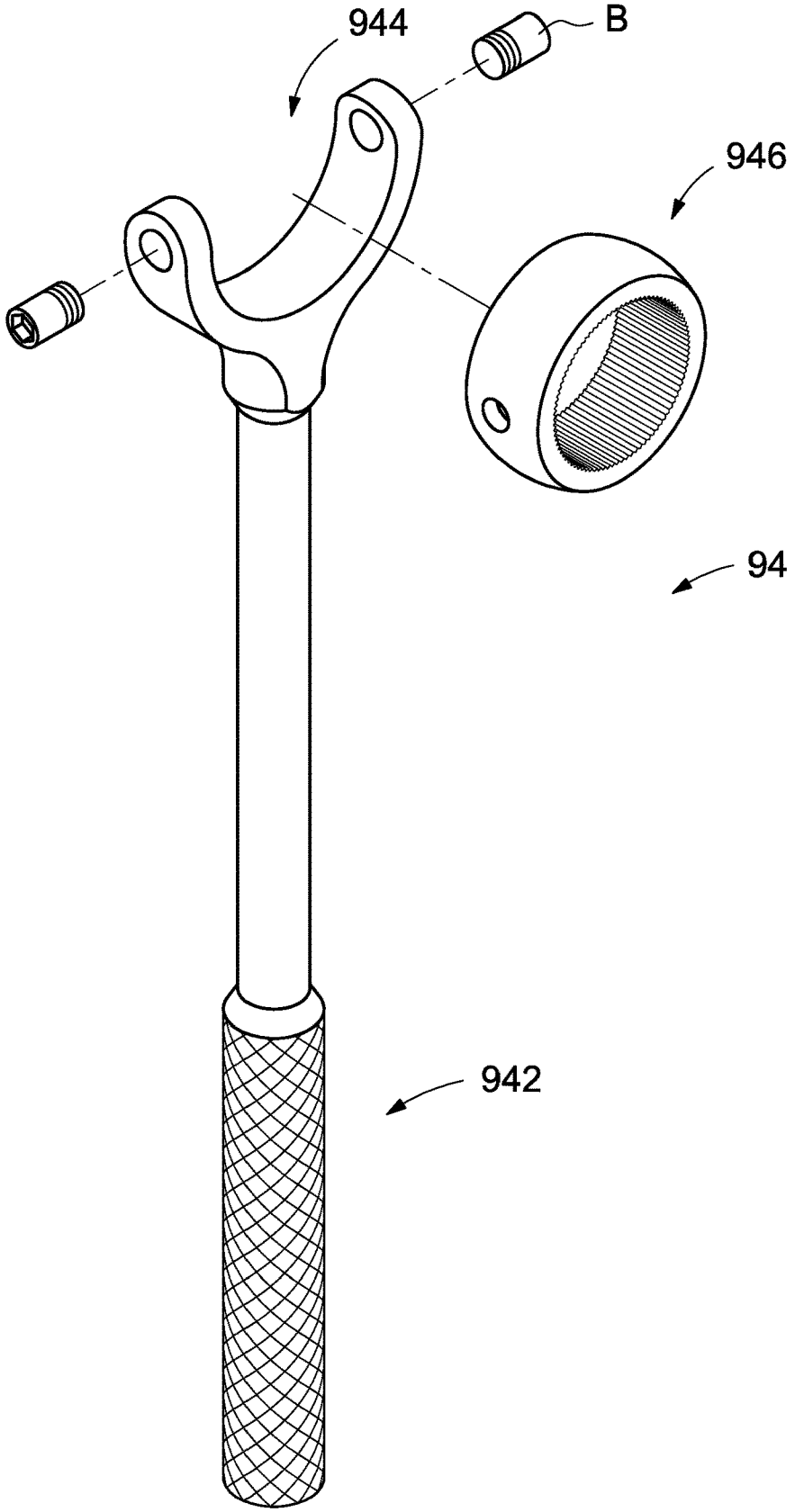
FIG. 12 is an exploded view of another conventional hand tool.
Figure 13:
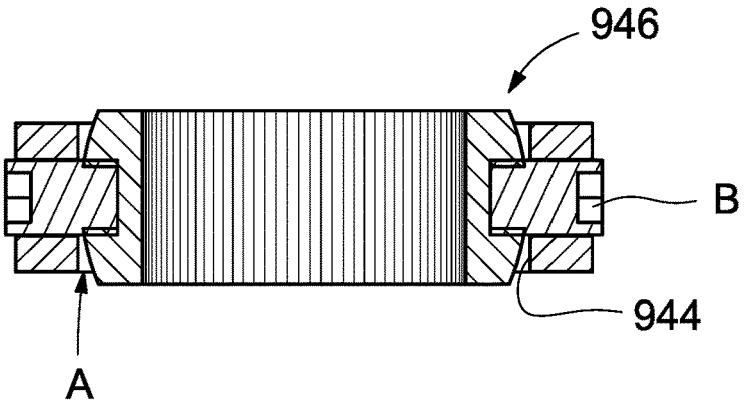
FIG. 13 is a cross-sectional view of the hand tool shown in FIG. 12.
Figure 14:
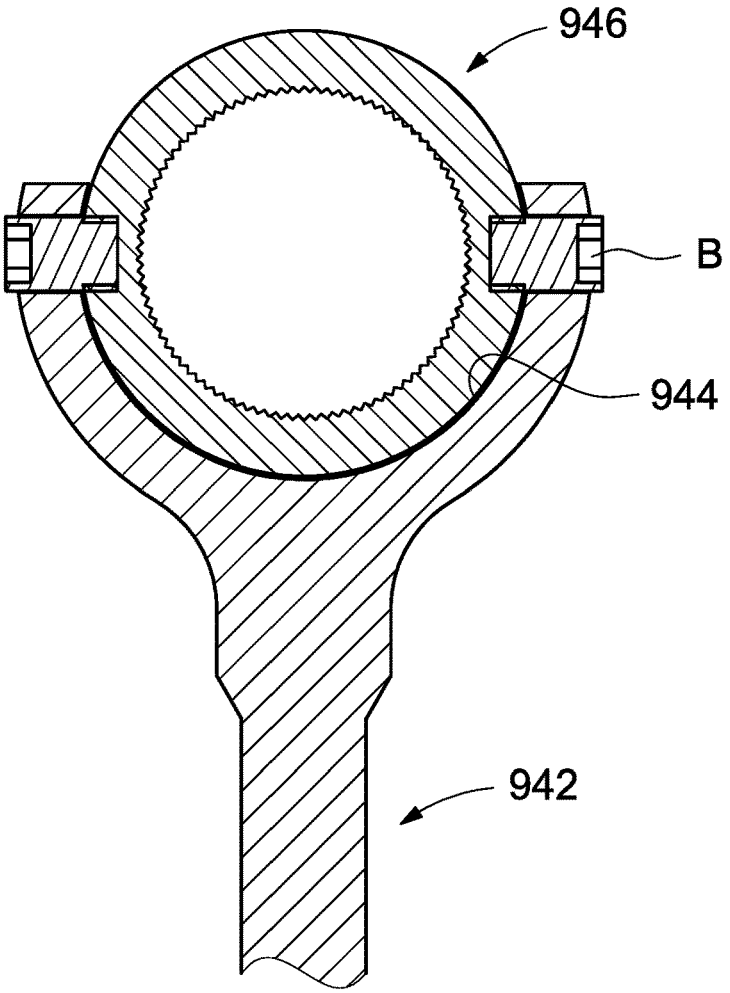
FIG. 14 is another cross-sectional view of the hand tool of FIG. 12.
Figure 15:
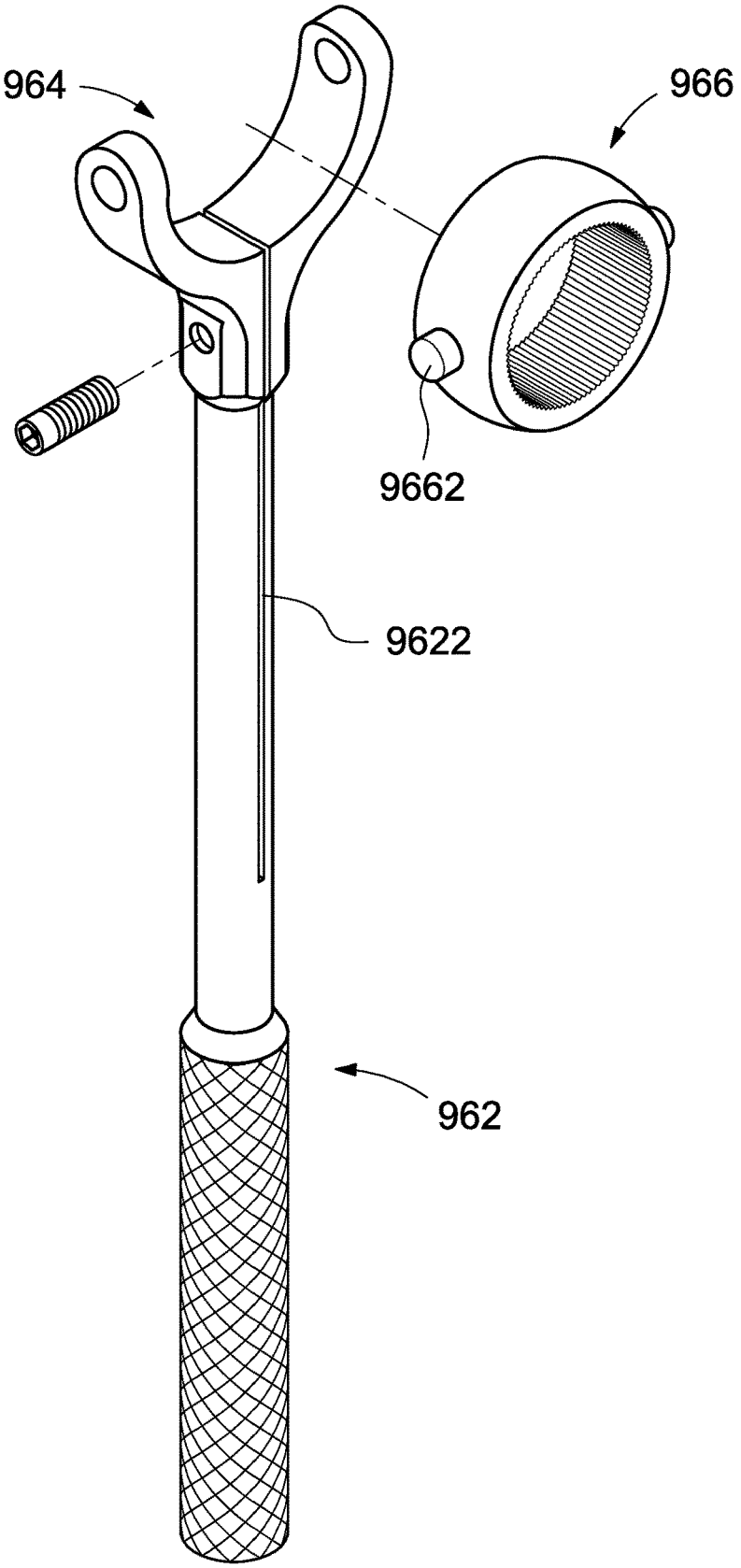
FIG. 15 is an exploded view of another conventional hand tool.
Figure 16:
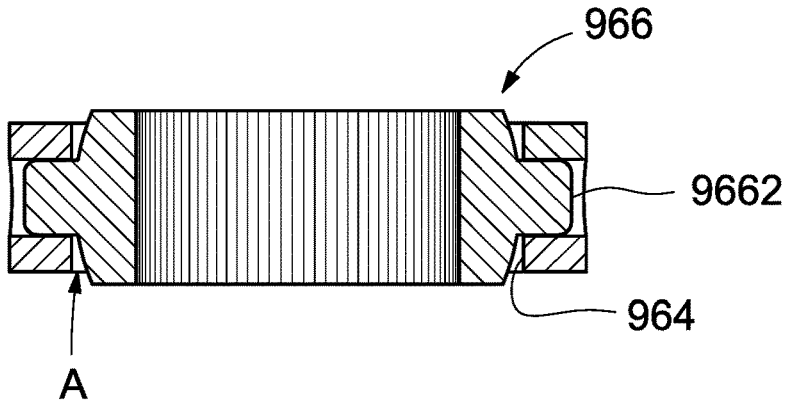
FIG. 16 is a cross-sectional view of the hand tool shown in FIG. 15.
Figure 17:
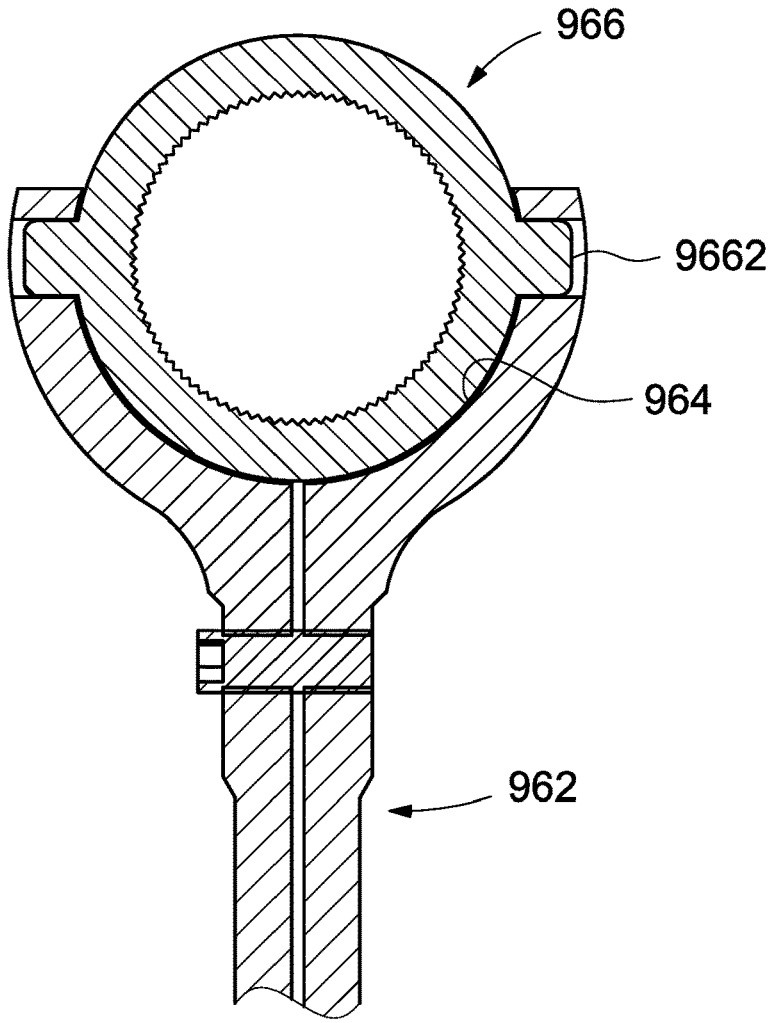
FIG. 17 is another cross-sectional view of the hand tool of FIG. 15.

At 300, the toothed ring 22 is located in the hemi-circular space 144. The axis of the toothed ring 22 is substantially overlapped with the common axis of the screw holes 1422. A center of the toothed ring 22 is near or coincides with the point 144A of the hemi-circular space 144 of the handle 10 (FIG. 5).

At 400, the toothed ring 22 is rotated relative to the bifurcated portion 14 of the handle 10 about an axis of the handle 10. Thus, the axis of the toothed ring 22 is pivoted away from the common axis of the screw holes 1422. Finally, a common axis of the bores 224 is substantially overlapped with the common axis of the screw holes 1422. That is, the bores 224 of the toothed ring 22 are aligned with the screw holes 1422 of the prongs 142. Now, the convex face 226 is located near the concave face 1442 of the hemi-circular space 144.

At 500, the screws 30 are inserted in the screw holes 1422 of the prongs 142, and the reduced ends of the screws 30 are inserted in the bores 224 of the toothed ring 22. Thus, the toothed ring 22 is pivotally connected to the bifurcated portion 14 of the handle 10 (FIG. 1).

At 600, the rotor 242 and the switch 244 are connected to the toothed ring 22. Thus, the internal portion of the rotor 242 and the internal portion of the switch 244 are engaged with the teeth 222 of the toothed ring 22 (FIGS. 1 and 2). The step represented by '600' can be executed before the step represented by '100.'

By the method of the present invention, the connection of the toothed ring 22 to the bifurcated portion 14 of the handle 10 is smooth. A rotor 242 of a desired size can be connected to the toothed ring 22 before it is engaged with a socket, a nut or a head of a threaded bolt of a desired size.

The user can hold and maneuver the grip 12 of the handle 10 so that the bifurcated portion 14 of the handle 10 rotates the toothed ring 22 of the engagement device 20. The toothed ring 22 rotates the rotor 242 of the selectively one-way rotating device 24. The convex face 226 is located very close to the concave face 1442 of the hemi-circular space 144. Thus, the screws 30 undergo relatively small stress in operation.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A method for making a hand tool comprising the steps of:

providing a handle (10) with a bifurcated portion (14), the handle (10) extending about a first axis, the bifurcated portion (14) comprising a concave face (1442) and two screw holes (1422) along a second axis;

providing a toothed ring (22) extending about a third axis and comprising a convex face (226) in compliance with the concave face (1442) and two bores (224) along a fourth axis;

moving the toothed ring (22) into a hemi-circular space (144) in the concave face (1442) while keeping the third axis parallel to the second axis;

overlapping the third axis with the second axis and coinciding a center of the toothed ring (22) with a middle point (144A) of a segment of the second axis in the bifurcated portion (14) of the handle (10);

rotating the toothed ring (22) about the first axis so that the fourth axis is overlapped with the second axis and that the bores (224) are aligned with the screw holes; and inserting two screws (30) in the screw holes (1422) so that a reduced end of each of the screws (30) is inserted in one of the bores (224).

2. The method according to claim 1, further comprising the step of connecting a rotor (242) and a switch (244) of a selectively one-way rotating device (24) to the toothed ring (22).

3. The method according to claim 1, further comprising the step of connecting a rotor (242) and a switch (244) of a selectively one-way rotating device (24) to the toothed ring (22) after the step of inserting two screws (30) in the screw holes (1422).

* * * * *